United States Patent [19]

Nichol et al.

[11] 4,456,482

[45] Jun. 26, 1984

[54] FERRITIC STAINLESS STEEL

[75] Inventors: Thomas J. Nichol, Cheshire, Conn.; Thomas H. McCunn, Lower Burrell, Pa.

[73] Assignee: Allegheny Ludlum Steel Corporation, Pittsburgh, Pa.

[21] Appl. No.: 386,464

[22] Filed: Jun. 8, 1982

Related U.S. Application Data

[63] Continuation of Ser. No. 109,373, Jan. 3, 1980, abandoned.

[51] Int. Cl.[3] ..... C22C 38/18

[52] U.S. Cl. ..... 75/126 C; 75/126 D; 75/126 F; 75/128 T; 75/128 W; 75/128 Z; 75/128 G; 428/683; 428/685

[58] Field of Search ..... 75/126 C, 126 D, 126 F, 75/126 J, 128 N, 128 Z, 128 T, 128 W, 128 G; 428/683, 684, 685; 148/37

[56] References Cited

U.S. PATENT DOCUMENTS 4,119,765 10/1978 Pinnow et al. ..... 75/128 G
4,155,752 5/1979 Oppenheim et al. ..... 75/128 Z
4,216,013 8/1980 Gemmel et al. ..... 75/128 T
4,255,497 3/1981 Bond et al. ..... 75/128 G

*Primary Examiner*—M. J. Andrews
*Assistant Examiner*—Debbie Yee
*Attorney, Agent, or Firm*—Patrick J. Viccaro

[57] ABSTRACT

A ferritic stainless steel characterized by superior crevice and intergranular corrosion resistance. The steel consists essentially of, by weight, up to 0.08% carbon, up to 0.06% nitrogen, from 25.00 to 35.00% chromium, from 3.60 to 5.60% molybdenum, up to 2.00% manganese, up to 2.00% nickel, up to 2.00% silicon, up to 0.5% aluminum, up to 2.00% of elements from the group consisting of titanium, zirconium and columbium, balance essentially iron. The sum of carbon plus nitrogen is in excess of 0.0275%. Titanium, zirconium and columbium, are in accordance with the following equation:

$$\%Ti/6+\%Zr/7+\%Cb/8 \geqq \%C+\%N$$

9 Claims, No Drawings

FERRITIC STAINLESS STEEL

This is a Continuation of Application Ser. No. 109,373, filed Jan. 3, 1980, now abandoned.

The present invention relates to a ferritic stainless steel.

U.S. Pat. Nos. 3,932,174 and 3,929,473 describe ferritic stainless steels having superior crevice and intergranular corrosion resistance. The steels described therein contain 29% chromium and 4% molybdenum. They also have a maximum carbon plus nitrogen content of 250 parts per million. Carbon and nitrogen are limited as the corrosion resistance of the steels deteriorates with increasing levels thereof.

The low carbon and nitrogen requirement for the alloys of U.S. Pat. Nos. 3,932,174 and 3,929,473 is disadvantageous in that it necessitates more expensive melting procedures, such as vacuum induction melting.

Through the present invention, there is provided an alloy having properties comparable to that of U.S. Pat. Nos. 3,929,174 and 3,929,473, yet one which does not require the expensive melting procedures referred to hereinabove. The alloy of the present invention can, for example, be melted and refined using argon-oxygen decarburization (AOD) procedures.

The alloy of the present invention has up to 2.00% of elements from the group consisting of titanium, zirconium and columbium in accordance with the following equation:

$$\%Ti/6+\%Zr/7+\%Cb/8 \geqq \%C+\%N$$

and a carbon plus nitrogen content in excess of 275 parts per million. It is characterized by superior crevice and intergranular corrosion resistance, by good weldability and by satisfactory toughness both prior to and after welding.

For the reasons noted hereinabove, the alloy of the present invention is clearly distinguishable from that of U.S. Pat. Nos. 3,932,174 and 3,929,473. It is also distinguishable from that of two other alloys, that of U.S. Pat. No. 3,957,544 and that of U.S. Pat. No. 4,119,765. Both of these alloys have maximum molybdenum contents below that specified for the present invention.

Another reference of interest is a paper entitled, "Ferritic Stainless Steel Corrosion Resistance and Economy". The paper was written by Remus A. Lula and appeared in the July 1976 issue of Metal Progress, pages 24–29. It does not disclose the ferritic stainless steel of the present invention.

It is accordingly an object of the present invention to provide a ferritic stainless steel.

The ferritic stainless steel of the present invention is characterized by superior crevice and intergranular corrosion resistance, by good weldability and by satisfactory toughness both prior to and after welding. It consists essentially of, by weight, up to 0.08% carbon, up to 0.06% nitrogen, from 25.00 to 35.00% chromium, from 3.60 to 5.60 molybdenum, up to 2.00% manganese, up to 2.00% nickel, up to 2.00% silicon, up to 0.5% aluminum, up to 2.00% of elements from the group consisting of titanium, zirconium and columbium, balance essentially iron. The sum of carbon plus nitrogen is in excess of 0.0275%. Titanium, zirconium and columbium are in accordance with the following equation:

$$\%Ti/6+\%Zr/7+\%Cb/8 \geqq \%C+\%N$$

Carbon and nitrogen are usually present in respective amounts of at least 0.005% and 0.010%, with the sum being in excess of 0.0300%. Chromium and molybdenum are preferably present in respective amounts of 28.50 to 30.50% and 3.75 to 4.75%. Manganese, nickel and silicon are each usually present in amounts of less than 1.00%. Aluminum which may be present for its effect as a deoxidizer is usually present in amounts of less than 0.1%.

Titanium, columbium and/or zirconium are added to improve the crevice and intergranular corrosion resistance of the alloy, which in a sense is a high carbon plus nitrogen version of U.S. Pat. Nos. 3,932,174 and 3,929,473. It has been determined, that stabilizers can be added to high carbon and/or nitrogen versions of U.S. Pat. Nos. 3,932,174 and 3,929,473, without destroying the toughness and/or weldability of the alloy. Although it is preferred to add at least 0.15% of titanium insofar as the sole presence of columbium can adversely affect the weldability of the alloy, it is within the scope of the present invention to add the required amount of stabilizer as either titanium or columbium. Columbium has a beneficial effect in comparison with titanium, on the toughness of the alloy. A particular embodiment of the invention calls for at least 0.15% columbium and at least 0.15% titanium. Titanium, columbium and zirconium are preferably present in amounts up to 1.00% in accordance with the following equation:

$$\%Ti/6+\%Zr/7+\%Cb/8=1.0 \text{ to } 4.0(\%C+\%N)$$

The ferritic stainless steel of the present invention is particularly suited for use as a welded article having a thickness no greater than 0.070 inch (usually no greater than 0.049 inch), and in particular, as welded condenser tubing which typically ranges from 0.026 to 0.037 inch.

The following examples are illustrative of several aspects of the invention:

Ingots from fifteen heats (Heats A through O) were heated to 2050° F., hot rolled to 0.125 inch strip, annealed at temperatures of 1950° or 2050° F., cold rolled to strip of from about 0.062 to 0.065 inch and annealed to temperatures of 1950° or 2050° F. Specimens were subsequently evaluated for crevice corrosion resistance. Other specimens were TIG welded and evaluated for crevice and intergranular corrosion resistance. The chemistry of the heats appears hereinbelow in Table I.

TABLE I

| | COMPOSITION (wt. %) | | | | | | | | | | |
|---|---|---|---|---|---|---|---|---|---|---|---|
| Heat | C | N | Cr | Mo | Mn | Ni | Si | Al | Ti | Cb | Fe |
| A | 0.042 | 0.022 | 29.09 | 4.00 | 0.24 | 0.31 | 0.34 | 0.039 | 0.31 | — | Bal. |
| B | 0.064 | 0.022 | 28.98 | 4.01 | 0.24 | 0.29 | 0.34 | 0.050 | 0.34 | — | Bal. |
| C | 0.020 | 0.021 | 29.08 | 4.00 | 0.24 | 0.29 | 0.33 | 0.023 | 0.26 | — | Bal. |
| D | 0.037 | 0.019 | 29.05 | 4.02 | 0.24 | 0.29 | 0.34 | 0.053 | 0.40 | — | Bal. |
| E | 0.039 | 0.014 | 28.88 | 4.02 | 0.24 | 0.30 | 0.33 | 0.055 | 0.61 | — | Bal. |
| F | 0.064 | 0.013 | 28.91 | 4.01 | 0.24 | 0.29 | 0.32 | 0.055 | 0.66 | — | Bal. |
| G | 0.015 | 0.015 | 29.10 | 4.02 | 0.35 | 0.41 | 0.38 | 0.010 | — | 0.38 | Bal. |

TABLE I-continued

| Heat | COMPOSITION (wt. %) | | | | | | | | | | |
|---|---|---|---|---|---|---|---|---|---|---|---|
| | C | N | Cr | Mo | Mn | Ni | Si | Al | Ti | Cb | Fe |
| H | 0.030 | 0.016 | 29.10 | 4.04 | 0.36 | 0.45 | 0.40 | 0.014 | — | 0.53 | Bal. |
| I | 0.029 | 0.019 | 28.92 | 4.04 | 0.35 | 0.54 | 0.39 | 0.016 | 0.20 | 0.39 | Bal. |
| J | 0.030 | 0.025 | 28.96 | 4.20 | 0.34 | 0.45 | 0.36 | 0.029 | 0.50 | — | Bal. |
| K | 0.030 | 0.026 | 29.05 | 4.18 | 0.34 | 0.46 | 0.37 | 0.029 | 0.20 | 0.32 | Bal. |
| L | 0.031 | 0.025 | 28.96 | 4.06 | 0.36 | 0.45 | 0.29 | 0.027 | 0.09 | 0.45 | Bal. |
| M | 0.034 | 0.027 | 28.95 | 4.20 | 0.43 | 0.46 | 0.37 | 0.040 | 0.19 | 0.41 | Bal. |
| N | 0.035 | 0.026 | 28.75 | 4.20 | 0.40 | 0.47 | 0.45 | 0.025 | 0.20 | 0.42 | Bal. |
| O | 0.032 | 0.024 | 29.52 | 4.10 | 0.37 | 0.51 | 0.28 | 0.030 | 0.31 | 0.44 | Bal. |

Additional data pertaining thereto appears hereinbelow in Table II.

TABLE II

| Heat | % C + % N | % Ti/6 + % Zr/7 + % Cb/8 |
|---|---|---|
| A | 0.064 | 0.052 |
| B | 0.086 | 0.057 |
| C | 0.041 | 0.043 |
| D | 0.056 | 0.067 |
| E | 0.053 | 0.102 |
| F | 0.077 | 0.110 |
| G | 0.030 | 0.048 |
| H | 0.046 | 0.066 |
| I | 0.048 | 0.082 |
| J | 0.055 | 0.083 |
| K | 0.056 | 0.073 |
| L | 0.056 | 0.071 |
| M | 0.061 | 0.083 |
| N | 0.061 | 0.086 |
| O | 0.056 | 0.107 |

Note that Heats A and B are outside the subject invention. They are not in accordance with the following equation:

$$\%Ti/6+\%Zr/7+\%Cb/8 \geqq \%C+\%N$$

Crevice corrosion resistance was evaluated by immersing 1 inch by 2 inch surface ground specimens in a 10% ferric chloride solution for 72 hours. Testing was performed at temperatures of 95° and 122° F. Crevices were created on the edges and surfaces by employing polytetrafluoroethylene blocks on the front and back, held in position by pairs of rubber bands stretched at 90° to one another in both longitudinal and transverse directions. The test is described in Designation: G48-76 of the American Society For Testing And Materials.

The results of the evaluation appear below in Table III.

TABLE III

| 10% FERRIC CHLORIDE CREVICE CORROSION TEST | WEIGHT LOSS (GRAMS) | | |
|---|---|---|---|
| Heat | Base Metal 122° F. | As Welded 95° F. | As Welded 122° F. |
| A | 0.0 | 0.0 | 0.4195 |
| B | 0.8519 | 0.0198 | 0.5783 |
| C | 0.0 | 0.0001 | 0.0004 |
| D | 0.0 | — | 0.0 |
| E | 0.0 | 0.0 | 0.0 |
| F | 0.0 | 0.0001 | 0.0 |
| G | — | — | 0.0 |
| H | — | — | — |
| I | — | — | 0.0 |
| J | — | — | 0.0003 |
| K | — | — | 0.0 |
| L | — | — | 0.0 |
| M | — | — | 0.0 |
| N | — | — | 0.0 |
| O | — | — | 0.0013 |

From Table III, it is noted that the crevice corrosion resistance of Heats C through G and I through O is superior to that for Heats A and B. Base metal from Heat B lost as much as 0.8519 gram. Welded metal from Heats A and B respectively lost as much as 0.4195 and 0.5783 gram. Significantly, Heats A and B are outside the subject invention. On the other hand, Heats C through G and I through O are in accordance therewith.

Intergranular corrosion resistance was evaluated by immersing 1 inch by 2 inch surface ground specimens in a boiling cupric sulfate-50% sulfuric acid solution for 120 hours. The usual pass-fail criteria for this test are a corrosion rate of 24.0 mils per year (0.0020 inches per month) and a satisfactory microscopic examination. This test is recommended for stabilized high chromium ferritic stainless steels.

The results of the evaluation appear hereinbelow in Table IV.

TABLE IV

| CUPRIC SULFATE - 50% SULFURIC ACID CORROSION TEST | | | |
|---|---|---|---|
| | CORROSION RATE - AS WELDED | | MICROSCOPIC EXAMINATION AS WELDED (AT 30×) |
| Heat | mils/year | inches/month | |
| A | 8.21 | 0.000684 | — |
| B | 141 | 0.011786 | — |
| C | 6.82 | 0.000568 | — |
| D | 9.94 | 0.000828 | — |
| E | 5.59 | 0.000466 | — |
| F | 11.0 | 0.000914 | — |
| G | 5.76 | 0.000480 | NA* |
| H | — | — | — |
| I | 6.29 | 0.000524 | NA |
| J | 6.61 | 0.000551 | NA |
| K | 5.59 | 0.000466 | NA |
| L | 5.24 | 0.000437 | NA |
| M | 5.78 | 0.000482 | NA |
| N | 5.28 | 0.000440 | NA |
| O | 6.35 | 0.000529 | NA |

*NA: NO INTERGRANULAR ATTACK OR GRAIN DROPPING

From Table IV, it is noted that only Heat B failed the subject test. Heat B had a corrosion rate of 141 mils per year. As stated hereinabove, it is one of the two heats outside the present invention. The other heat, being Heat A. It is, however, further outside the subject invention than is Heat A in that it has a lower titanium to carbon plus nitrogen ratio.

Toughness was evaluated by determining the transition temperature using Charpy V-notch specimens for hot rolled and annealed material (0.125×0.394 inch specimens) and for as welded material (0.062 to 0.065×0.394 inch specimens). Transition temperature was based upon a 50% ductile-50% brittle fracture appearance. The transition temperatures appear hereinbelow in Table V.

TABLE V

| TRANSITION TEMPERATURE (°F.) | | |
|---|---|---|
| Heat | As Welded | Hot Rolled And Annealed |
| A | 25(1) | 165(3) |
| B | 60(1) | 185(3) |
| C | 80(1) | 155(3) |
| D | 115(1) | 185(3) |
| E | 245(1) | 195(3) |
| F | 220(1) | 190(3) |
| G | −35(2) | 95(4) |
| H | — | 120(4) |
| I | 95(2) | 160(4) |
| J | 110(2) | 130(4) |
| K | 60(2) | 120(4) |
| L | 90(2) | 110(4) |
| M | 105(2) | 135(4) |
| N | 155(2) | 140(4) |
| O | 130(2) | 210(4) |

(1)Strip annealed prior to welding at 2050° F. - air cooled
(2)Strip annealed prior to welding at 1950° F. - water quenched
(3)Annealed at 2050° F. - water quenched; transverse test
(4)Annealed at 1950° F. - water quenched; transverse test The transition temperatures indicate that the steel of the present invention can be cold rolled, formed and welded, although some preheating might at times be desirable. The columbium-bearing specimens had lower transition temperatures than the titanium-bearing specimens. The specimens containing both titanium and columbium had transition temperatures between that of the columbium-bearing and titanium-bearing specimens.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A corrosion-resistant tough, weldable ferritic stainless steel consisting essentially of, by weight, from 0.0050% up to 0.08% carbon, from 0.0100% up to 0.06% nitrogen, from 28.5 to 30.5% chromium, from 3.60 to 5.60 molybdenum, up to 2.00% manganese, up to 2.00% nickel, up to 2.00% silicon, up to 0.5% aluminum for deoxidizing the steel, up to 2.00% of elements from the group consisting of titanium, zirconium and columbium, balance essentially iron; said titanium, zirconium and columbium being in accordance with the following equation:

$$\%Ti/6+\%Zr/7+\%Cb/8 \geqq \%C+\%N$$

the sum of said carbon plus said nitrogen being in excess of 0.0275%; said steel being characterized by its as-welded crevice corrosion resistance at 50° C. (122° F.).

2. A ferritic stainless steel according to claim 1, having at least 0.005% carbon and at least 0.010% nitrogen, the sum of said carbon plus said nitrogen being in excess of 0.0300%.

3. A ferritic stainless steel according to claim 1, having from 3.75 to 4.75% molybdenum.

4. A ferritic stainless steel according to claim 1, having up to 1.00% of elements from the group consisting of titanium, zirconium and columbium in accordance with the following equation:

$$\%Ti/6+Zr/7+\%Cb/8=1.0 \text{ to } 4.0(\%C+\%N)$$

5. A ferritic stainless steel according to claim 1, having at least 0.15% titanium.

6. A ferritic stainless steel according to claim 5, having at least 0.15% columbium.

7. A ferritic stainless steel according to claim 1, having at least 0.005% carbon, at least 0.010% nitrogen, from 28.50 to 30.50% chromium, from 3.75 to 4.75% molybdenum, less than 1.00% nickel, less than 0.1% aluminum, and up to 1.00% of elements from the group consisting of titanium, zirconium and columbium in accordance with the following equation:

$$\%Ti/6+\%Zr/7+\%Cb/8=1.0 \text{ to } 4.0(\%C+\%N)$$

the sum of carbon plus said nitrogen being in excess of 0.0300%.

8. A welded article made of the steel of claim 1.

9. A welded condenser tubing made of the steel of claim 1.

* * * * *